United States Patent [19]

Pinson et al.

[11] 4,203,347

[45] May 20, 1980

[54] SHOCK SUPPRESSING APPARATUS AND METHOD FOR A ROCKET LAUNCHER

[75] Inventors: George T. Pinson; Alex B. Hunter, both of Huntsville, Ala.

[73] Assignee: The Boeing Company, Seattle, Wash.

[21] Appl. No.: 895,247

[22] Filed: Apr. 10, 1978

[51] Int. Cl.[2] ..... F41F 3/04

[52] U.S. Cl. ..... 89/1.816; 89/1.703; 89/14 B

[58] Field of Search ..... 89/1.7, 1.702, 1.703, 89/1.704, 1.8, 1.816, 1.818, 14 B, 14 C, 14 D; 239/265.11, 265.15

[56] References Cited

U.S. PATENT DOCUMENTS

| | | | |
|---|---|---|---|
| 916,885 | 3/1909 | Maxim | 89/14 D X |
| 951,770 | 3/1910 | Miller | 89/14 D |
| 1,427,802 | 9/1922 | Goodwin | 89/14 D |
| 1,874,326 | 8/1932 | Mason | 89/14 D |
| 1,939,700 | 12/1933 | Hofstetter | 89/14 B |
| 3,026,775 | 3/1962 | Musser | 89/1.7 |
| 3,035,494 | 5/1962 | Musser | 89/1.703 |
| 3,208,384 | 9/1965 | Fountain | 89/1.8 X |
| 3,561,679 | 2/1971 | Lager | 89/1.8 X |
| 3,745,876 | 7/1973 | Rocha | 89/1.705 X |
| 4,091,709 | 5/1978 | Spurk | 89/1.704 X |

*Primary Examiner*—David H. Brown

[57] ABSTRACT

A shock suppressing device adapted to be attached to the aft end of a shoulder-fired rocket launcher. The device comprises a cylindrical housing defining a substantially enclosed expansion chamber having a diameter and cross-sectional area greater than that of the exhaust end of the launch tube. A plurality of annular baffles extend radially inwardly from the cylindrical housing and define aligned through openings through which a plug from a rocket being launched can be emitted rearwardly from the launch tube. The initial shock which follows the expulsion of the plug from the rocket is spread outwardly into the expansion chamber to engage the baffles therein. The baffles suppress the shock by absorbing a substantial portion of the energy of the shock wave, and also partially reflecting the shock wave in an upstream direction toward the launch tube. In the preferred form, the housing is made of several members which telescope together for storage, and are pulled out to an expanded position for use.

39 Claims, 15 Drawing Figures

FIG. 7
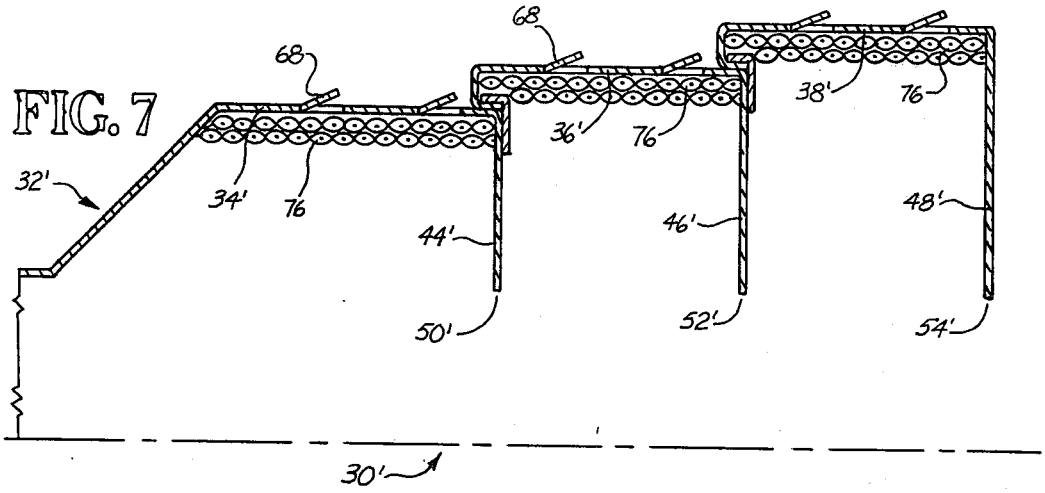
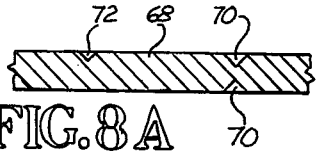
FIG. 8A
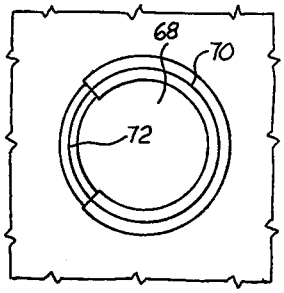
FIG. 8B
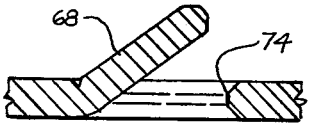
FIG. 8C
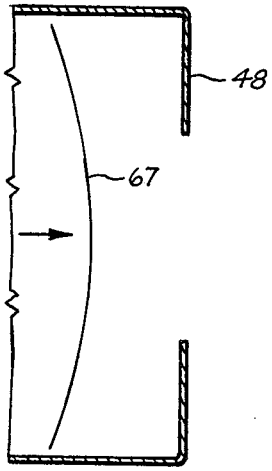
FIG. 9A
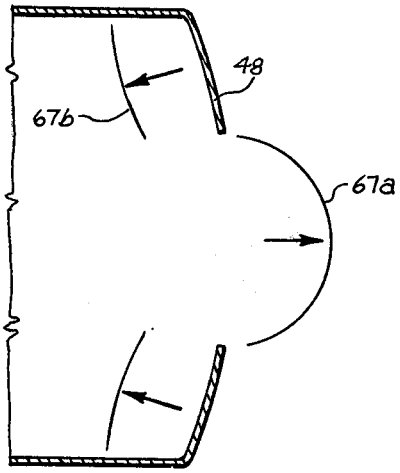
FIG. 9B

SHOCK SUPPRESSING APPARATUS AND METHOD FOR A ROCKET LAUNCHER

BACKGROUND OF THE INVENTION

A. Field of the Invention

The present invention relates to a shock suppressing apparatus and method for a shoulder-fired rocket launcher.

B. Brief Description of the Prior Art

A typical prior art shoulder-fired rocket launcher comprises an elongate tube which in its firing position is placed on the shoulder of the operator, with the forward end (through which the rocket is discharged) being positioned several feet forward of the operator's head, and with the rear end being a short distance rearwardly of the operator's head. The rocket itself is located in the rear end of the launch tube, and the rocket nozzle is closed by a plug. Upon ignition, there is a very rapid pressure build up in the rocket propellant chamber, and at a predetermined design pressure level, the nozzle plug is expelled from the nozzle rearwardly at a high velocity, generally in the supersonic range. The rocket is then propelled forwardly through the tube toward its intended target, with the exhaust of the rocket being emitted outwardly from the rear end of the launch tube. The noise pulse which is generated is at a level that requires the weapon user to wear ear plugs and ear muffs to protect his hearing. Even when using such protective equipment, the noise pulse is at the maximum upper limit that can be tolerated by humans. Thus, a technology barrier exists which prevents the development of increased performance systems.

To reduce the ignition noise level, considerable research has been conducted to optimize the pressure level and propellant burn time reached before the plug is expelled. This research has been successful in varying these parameters; however, it has not been successful in reducing the noise level to any significant extent.

Another prior art attempt to reduce the noise level is based on energy conversion. One example of this is illustrated by the "Armbrust Weapon System". The basic technique is to both perform mechanical work and to contain the gases generated by the firing inside a pressure vessel. In this system, both the missile and an inert mass are enclosed in a pressure chamber of a launch tube, with a motor being placed between the missile and the inert mass. When the weapon is fired, the missile and the inert mass move in opposite directions to minimize recoil, and the motor exhaust products are trapped inside the pressure chamber. The gases are released over a relatively long period of time, with the noise being reduced by trapping the exhaust gases and releasing them over a long period of time. While the approach used in this system is effective, it has several severe drawbacks. First, it is heavy since the missile and the inert mass must have approximately the same mass, and the pressure chamber must be strong enough to hold the motor exhaust products. Thus, this apparatus is approximately twice as heavy as a conventional rocket system. Also, it is expensive to fabricate.

Some experimental work has been done to solve this noise problem by utilizing classical muffler design techniques. However, this work indicates that such muffling devices are too large for practical utility. Further, such devices are not effective for solving the peak noise problem.

There also have been some attempts to utilize techniques which have been effective on large jet and rocket engines, and also techniques utilized in recoilless weapons. Such techniques included the use of wire screens, multiple nozzles and fingers placed in the exhaust stream. Such techniques are effective in disrupting the steady state noise condition that occurs after the peak ignition transient. However, such techniques did not prove to be effective in resolving the peak noise problem.

A review of the patent literature disclosed various devices which are attached to rocket launchers or other weapon system to affect the flow of exhaust gases which are emitted. However, to the best knowledge of the applicants herein, none of these devices are adequately effective in reducing the peak noise levels in a shoulder-fired missile system. The U.S. Patents noted in a search of the prior art are noted below.

U.S. Pat. No. 2,466,714, Kroeger et al, discloses a recoilless firearm which can be shoulder mounted. The propellant charge is located in a perforated cylinder. When the propellant is ignited, frangible covers over holes are blown out and gases are released from the perforated cylinder. A nozzle provides a forward impulse to the rocket launcher counter-acting the recoil generated by the acceleration of the missile down the launch tube. The noise sources for this device are similar to those of a similar rocket system, with a substantial initial shock being emitted from the multiple openings. Analysis indicates that this device would not be adequate to effect any substantial reduction of peak noise levels.

U.S. Pat. No. 2,489,747, Burney, discloses a gun which is designed to reduce recoil. This device uses the thrust generated by burning an excessive powder charge and allowing the gases to escape through a rather standard divergent nozzle to affect the recoil generated by the motion of a projectile down the barrel. A screen is placed in front of the nozzle to keep the burning propellant inside the combustion chamber. Analysis indicates that the noise sources of this system are not significantly different than would be expected from a standard rocket motor.

U.S. Pat. No. 2,489,748, Burney, discloses a device having basic similarities to the patent of the same inventor noted immediately above. Analysis indicates that the sound characteristics of this device would be the same as that in the first mentioned Burney patent.

U.S. Pat. No. 2,866,316, Towle et al, discloses a thrust reversing and sound suppressing device for a jet engine. The exhaust of the engine is released to the atmosphere through multiple individual nozzles, with the primary effect being to break up the simple jet stream from the power plant into a number of smaller jets. Analysis indicated that this would not be effective in significantly reducing the peak noise generated by a rocket launcher such as that for which the present invention is adapted.

U.S. Pat. No. 2,986,973, discloses a device which is entitled, "Low-Recoil, Variable-Range Missile Projector". The objectives of this device are to reduce recoil and to provide a means to vary the range of the projectile without changing the elevation angle or changing the propellant charge. A countercharge is burned in a chamber which has a number of holes on the sides. The gases propel the missile down and out the tube, with hot gases escaping normal to the axial flow through orifices which split the escaping gases in a forward and aft direction, thereby neutralizing the recoil. Analysis indicates that each of the vent openings and nozzles would be a separate noise source and thus would be a relatively complex noise producer rather than a noise suppressor.

U.S. Pat. No. 3,035,494, discloses a recoil adjust device for a weapon system. Specifically the device incorporates a mechanism to compensate for wear, erosion, or fouling of the nozzles or other openings in the recoil system by changing the position of an adjustable compensator. The compensator functions as a preliminary gas flow restrictor placed ahead of the choked venturies. As the adjustable compensator or other elements wear, the compensator is adjusted to reduce the gap between the compensator and the chamber wall, thereby restoring the original flow conditions necessary to eliminate or compensate for the recoil of the system. Analysis indicates that the sound characteristics of this device do not differ significantly from the characteristics of a standard rocket motor, with each separate venturi or nozzle being a separate noise emitter.

U.S. Pat. No. 3,129,636, Strickland et al, shows a projectile launching system designed to eliminate recoil. There is a nozzle plug which is attached to the projectile. Since the effective area of the nozzle plug is less than the effective area of the projectile, the pressure generated after ignition causes the projectile to be accelerated down the launch tube. With regard to the noise generated by this device, analysis indicates that as soon as the nozzle plug was removed, the propellant gases go through a standard convergent/divergent underexpanded nozzle. It is anticipated that there would be no significant suppression of an initial pressure wave generated from the nozzle.

U.S. Pat. No. 3,208,384, Fountain, shows a rocket launching system adapted to be mounted to an aircraft. The objective of this particular device is to both neutralize the thrust of a rocket motor and to deflect the hot gas flow forward and aft to prevent the hot gases from damaging the surfaces of the aircraft to which the launcher is attached, in the event of an accidental ignition. The gases generated by the rocket motor are turned 90° and emitted through numerous gas escape orifices perpendicular to the center line of the missile. This neutralizes the thrust. The deflector spreads the gases into forward and aft components, thereby protecting the aircraft from damage by the hot propulsive gases generated by the rocket motor. Analysis indicates that this device would not be effective in obtaining a significant decrease in peak noise suppression.

U.S. Pat. No. 3,380,340, Bergman et al, discloses a weapon system designed to decrease recoil. The propellant is contained in a pressure chamber that is centered and supported in the launcher by a number of centering supports. The launcher itself is fitted with a nozzle designed to provide a force in the forward direction if high pressure gases are released through it to the atmosphere. The high pressure chamber is also fitted with a nozzle for the purpose of providing a force in the forward direction as gases escape through it to the atmosphere. Both the launcher and the pressure chamber nozzles contain plugs designed to break at the same gas pressure at which the shear pin that attaches the projectile to the launcher breaks. When the weapon is fired, the propellant burns and the gas escapes from the holes in the pressure chamber. The pressure inside the launcher increases up to the point where the shear pin is broken, and the gases begin to escape through both the pressure chamber and launcher nozzles to offset the recoil created by the reaction of the projectile. Analysis indicates that escaping gases impinging on the projectile sets up a shock wave that is a primary sound source. This would be followed by a pressure wave from the front of the launcher. Gases escaping from the front of the launcher would create a noise source. When the nozzle pressure plugs burst or are ejected, a series of shocks will be set up by the escaping debris or plugs, followed by an overpressure wave originating from the combined effect of both nozzles. It is not expected that this would result in any decrease of noise, and could under some circumstances actually increase the noise level of the launcher.

U.S. Pat. No. 3,490,330, Walther, describes a projectile launching system which reduces recoil and noise by combining the use of a pressure chamber and using multiple small orifices. When the propellant charge is ignited, the gas acts against a piston which in turn pushes the projectile down the launch tube. At the exit end of the tube, there is an interceptor which retains the piston, so that the piston thereby plugs the front end of the launch tube to prevent propellant gases from escaping from the front of the launcher. The launcher, therefore, acts as a pressure vessel, and the propellant gases are vented to the atmosphere through a series of nozzles. This system reduces the impulse noise by greatly increasing the time period over which the propulsive gases are released to the atmosphere and by breaking up the single exhaust flume into a large number of separate sources.

U.S. Pat. No. 3,505,958, Vilvajo, discloses a weapon system designed to eliminate recoil by firing one charge to accelerate the projectile toward the target, and at the correct point in time firing a second charge that is exhausted in the opposite direction through a nozzle, thereby producing a forecoil that equals the recoil generated by the projectile. The patent pertains to the delay fusing system and does not address itself to the problem of noise generated at firing. Analysis indicates that this device would generate a complex noise pattern made up of a noise generated by the shock from the projectile, the initial overpressure wave and the transonic shear layer. This would be followed at a later time by an initial overpressure wave and noise from the transonic shear layer from the second rocket motor firing. It is anticipated that this device is a noise generator instead of a noise suppressor.

U.S. Pat. No. 3,561,679, Lager, discloses a collapsible nozzle, the objecting being to reduce the size of the rocket nozzle by collapsing it, and then having the nozzle expand to its operating condition after the motor is ignited. The noise sources of this device are substantially the same as those of a rocket using a conventional noncollapsed nozzle. Analysis indicates that this would have no significant effect in reducing noise.

U.S. Pat. No. 3,745,876, Rocha, discloses an anti-tank weapon that has a launch tube which can be collapsed into a small easily-carried package. When the weapon is to be used, the launch tube is extended and the weapon fired from the shoulder in a conventional manner. Analysis indicates that as the gases move down the tube, there would be no signficant reduction in peak noise level.

U.S. Pat. No. 3,815,469, Schubert et al, discloses a launching system for missiles, particularly anti-tank projectiles, which is similar to the Armbrust system discussed previously herein. When the propellant is ignited, the gases react against two pistons. The projectile is accelerated down the launch tube in a conventional manner. When the projectile exits from the launch tube, the piston is captured by an interceptor at the forward end of the tube, and the forward end of the launch tube is thus sealed, thereby making the launch tube a pressure container. At the same time the second piston is driven toward the aft end of the launcher to cause an expendable mass or jelly to be extruded through a plurality of inverse nozzles. The momentum of the jelly mass is designed to equal the projectile momentum, thereby cancelling out the recoil. When the jelly is expended, the piston seals the jelly nozzles, thereby completing the seal on the launch tube as a pressure bottle. The gases are then allowed to decay to atmospheric pressure over a long period of time, thereby reducing the sound.

SUMMARY OF THE INVENTION

The apparatus of the present invention is adapted for use with a rocket launching device which comprises an elongate launch tube having a longitudinal axis, a forward end from which a rocket is fired, and a rear exhaust end through which exhaust gases exit during firing of the rocket. The exhaust end of the launch tube has a predetermined crosssectional area and diameter.

The shock wave suppressing apparatus of the present invention comprises a circumferential housing structure having a longitudinal axis, a forward end adapted to be mounted to the rear end of the launch tube so that the longitudinal axis at the housing is in general alignment with the longitudinal axis of the launch tube, and a rear end. The housing structure defines a substantially enclosed expansion chamber having a diameter and cross-sectional area substantially greater than the diameter and cross-sectional area of the exhaust end of the launch tube.

Annular baffle means extends from the housing radially inwardly toward the longitudinal axis of the housing. The baffle means defines longitudinally aligned opening means to permit rearward ejection of a nozzle plug from a rocket mounted in the launch tube and to permit rearward discharge of gaseous exhaust from the rocket. The baffle means presents forwardly facing surface means to reflect a shock wave or waves emitted from the launch tube.

Thus, with the shock suppressing apparatus mounted to the launch tube, a shock wave generated by firing the rocket in the launch tube travels rearwardly and expands into the expansion chamber. The shock wave is partially absorbed by the suppressing apparatus, and partially reflected back toward the launch tube, thereby suppressing the shock wave.

In the preferred form, the baffle means comprises a plurality of longitudinally spaced, radially inwardly extending baffles positioned in the expansion chamber along the longitudinal axis of the housing. Each of the baffles has a center through opening and presents a generally forwardly facing reflecting surface to partially absorb and partially reflect shock wave portions impinging thereagainst.

Preferrably the housing is formed as a plurality of housing sections, arranged relative to one another to have a collapsed stored position for the housing sections telescoped one within the other, and an expanded operating position with the telescoping sections spaced longitudinally from one another to define the expansion chamber.

Substantial sound suppression can be achieved if the diameter of the expansion chamber is at least as great as approximately two and a half times the diameter of the openings, and with each of the baffle members each having an area at least as great as approximately five times the area of each of the openings defined by each baffle member. Experimental results indicate that yet greater sound attenuation can be achieved by providing the expansion chamber with a diameter at least as great as approximately five times the diameter of each of said through openings defined by each of the baffles, with the surface area of each baffle being at least as great as approximately twenty-four times the area of the opening defined thereby.

Desirably the baffle means is made of a moderately yielding material, having a yield strength which is such relative to the shock wave generated by the launcher that the baffle means will yield moderately under the impact of the shock wave and thus diminish the energy of the shock wave. Also, it is desirable that the baffle means be made of a sound energy absorbing material so that in addition to reflecting the shock wave impinging thereon, a substantial amount of the energy of the shock wave is absorbed in the sound absorbing material.

In one embodiment, the housing structure comprises a circumferential side wall with a plurality of deformable plug members at spaced locations in the side wall. These plug members are deformable outwardly under impact of the shock wave thereon to provide through openings when so outwardly deformed. The plug members thus absorb energy in being outwardly deformed and also provide sound attenuating openings in the housing.

Further sound attenuation can be achieved by locating within said circumferential side wall a perforate sound absorbing material. Thus when gas is emitted into said expansion chamber, it passes through the sound absorbing material and then outwardly through the openings formed by deformation of said plugs outwardly from said housing structure.

In the method of the present invention, a shock wave emitted from a rear end of a rocket launcher is suppressed by providing a substantially closed expansion chamber immediately downstream of the aft end of the launch tube, and positioning radially extending baffle means at said expansion chamber, with center opening means being provided to permit ejection of a plug from said rocket nozzle and exhaust of gases from said launch tube. The baffle means both absorb and reflect a shock wave or waves emitted from said launch tube to diminish the energy of said shock wave or waves. In the preferred form, the baffle means is provided as a plurality of inwardly extending baffles spaced longitudinally from one another. Desirably, the baffles are made so as to yield moderately under impact of the shock, and preferrably the baffle material itself is made of a sound absorbing material, such as a noise decoupling material.

Other features of the present invention will become apparent from the following detailed description.

BRIEF DESCRIPTION OF THE DRAWING

FIG. 7 is a longitudinal sectional view, illustrating the upper half of a shock suppressing apparatus of a second embodiment of the present invention;

FIG. 8A is a sectional view, drawn to an enlarged scale, of one section of the wall of the shock suppressor of the second embodiment, having a deformable wall portion which is able to open to form a tuned orifice in the wall section;

FIG. 8B is a top plan view of the wall portion shown in FIG. 8A;

FIG. 8C is a view similar to FIG. 8A, but showing the deformable wall portion moved to its open position after firing of the rocket;

FIG. 9A is a semi-schematic sectional view of the rear baffle of the first embodiment, with a shock wave traveling toward the rear baffle;

FIG. 9B is a view similar to FIG. 9A, but illustrating the configuration of the rear baffle immediately after encountering the shock wave;

DESCRIPTION OF THE PREFERRED EMBODIMENTS

It is believed that a better appreciation of the present invention will be obtained if a detailed description thereof is preceded by a general description of a typical shoulder-fired rocket launcher and the nature of the sound generated by such a launcher.

Figure 1:
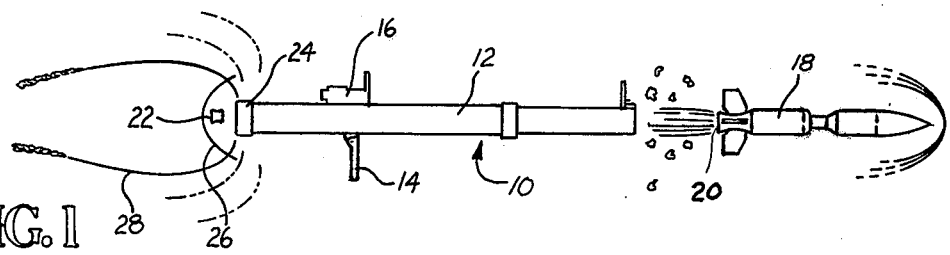
FIG. 1 PRIOR ART
FIG. 1 is a side elevational view of a rocket launcher for which the shock suppressing device of the present invention is particularly adapted.
Figure 2:
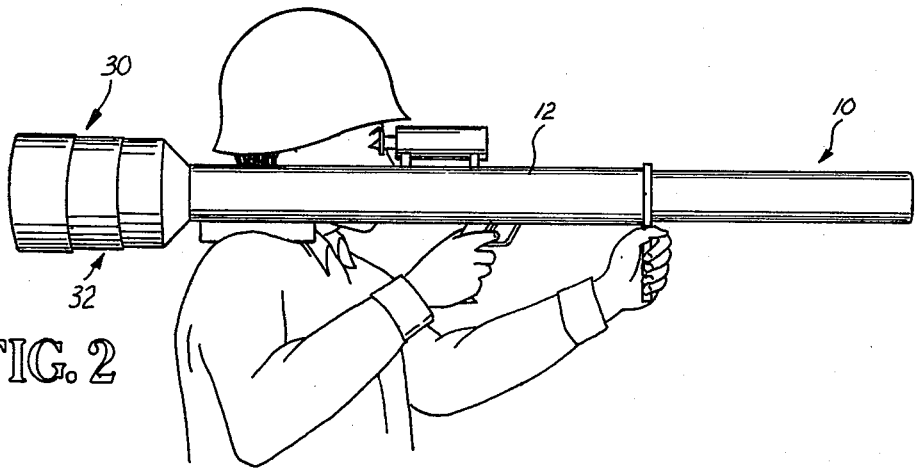
FIG. 2 is a side elevational view of a launcher somewhat similar to that shown in FIG. 1, in its firing position on the shoulder of an operator, and with the shock suppressing apparatus of the present invention attached to the aft end of the launcher.

A prior art rocket launcher 10 is shown in FIG. 1, and can be seen to comprise an elongate tube 12 having one or more handles 14 and a sighting device 16. A rocket 18 is mounted in the aft end of the tube, and the nozzle 20 of the rocket is closed by a plug 22 positioned in the throat of the nozzle 20. When the propellant in the rocket is ignited, the plug causes the pressure in the combustion chamber to build up to a required level before the plug 22 is expelled. When the pressure is at the proper level, the plug is expelled from the nozzle 20 and moves a short distance outwardly through the aft end of the tube 12 at a very high velocity, generally in the supersonic range. The rocket 18 then proceeds out the front end of the tube 12. This is shown in FIG. 1.

With regard to the noise that is generated by the firing of the rocket 18, the ignition of the rocket 18 is in many respects similar to an explosion. In the first milli-second after ignition, the ejection of the plug 22 is followed by a pulse of high pressure gas. As the plug leaves the nozzle 20 and the aft end 24 of the tube 12, it creates a pressure pulse in the form of a shock wave emitted from the aft end 24 of the tube 12. The peak noise levels are generated within the first milli-second or so after ignition, with this peak noise being in the form of a shock wave indicated schematically at 26 in FIG. 1. As the exhaust gas leaves the nozzle 20 a second pressure pulse is generated that may or may not be in phase with the pressure pulse generated by the motion of the nozzle plug 22. However, in any case, the second pressure pulse reinforces the first pressure pulse. After the initial shock or shocks, there is a quasisteady state noise generated by the gases which continue to be discharged from the aft end of the tube 12, due to the shearing stresses and violent mixing that occurs between the exhaust products and the ambient atmosphere. The location of this noise source is indicated schematically at 28 in FIG. 1. The main function of the present invention is to reduce to a substantial extent the pressure pulse or pulses initially generated by the firing of the rocket 18.

The first embodiment of the present invention is illustrated in FIGS. 2–6, and is generally designated 30. This shock suppressor 30 has a first collapsed position (illustrated in FIGS. 3 and 5) and a second expanded operating position (illustrated in FIGS. 2, 4 and 6). The suppressor 30 comprises a generally cylindrical housing 32 made in three telescoping sections 34, 36 and 38. The aft end of the two sections 34 and 36 are provided with forwardly extending circumferential retaining flanges 40. The forward edges of the two telescoping sections 36 and 38 are each provided with an inwardly reaching circumferential lip 42 which is arranged to engage a related flange 40 when the housing 32 is in its expanded position.

Each housing section 34, 36 and 38, has at its rear edge an inwardly extending annular baffle 44, 46 and 48, respectively. These three baffles 44, 46 and 48 each define a related one of three substantially circular through openings 50, 52 and 54.

The forward end of the first telescoping section 34 has a frusto-conical section 56 which tapers inwardly in a forward direction, and a cylindrical sleeve 58 which extends from the forward end of the frusto-conical section 56. To mount the shock suppressor 30 to the launch tube 12, the sleeve portion 58 is slipped over the rear end portion of the launch tube 12 and retained thereon by a suitable fastening device. Since such fastening devices are well known in the prior art, this will not be described herein.

Figure 4:
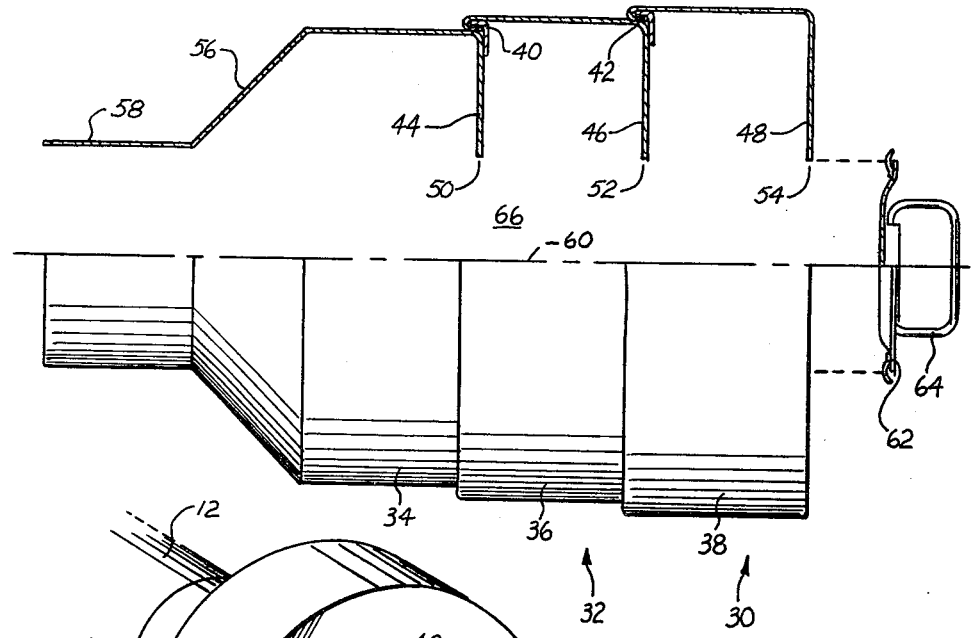
FIG. 4 is a view similar to FIG. 3, with the shock suppressing device in its expanded position.

The shock suppressor 30 can be considered as having a longitudinal center axis, indicated at 60 in FIG. 4, and a radial axis perpendicular to the center axis 60. With the shock suppressor 30 in its operating position (i.e. mounted on the aft end of the launch tube 12), the longitudinal axis 60 of the shock suppressor 30 is coincident with the longitudinal center axis of the launch tube 12. Also, the three through openings 50, 52 and 54 defined by the three baffles 44, 46 and 48 are aligned with, and centered on the longitudinal axis 60. The rear opening 54 is closed by a removable cap member 62 having a handle 64 on its rear surface.

Figure 3:
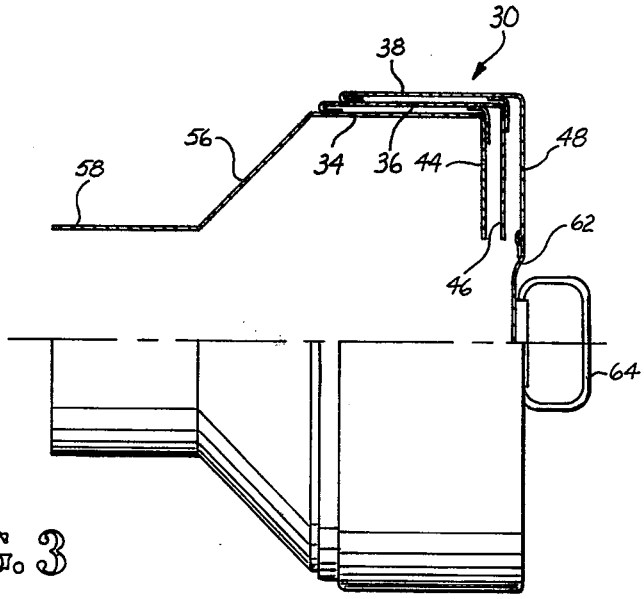
FIG. 3 is a side view, partly in section, of a first embodiment of the sound suppressing device of the present invention in its collapsed position.
Figure 5:
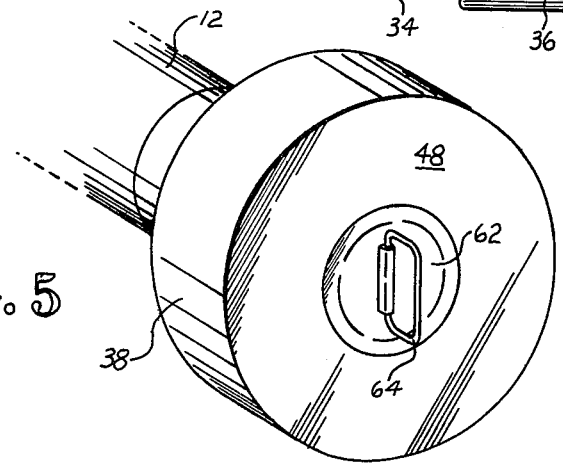
FIG. 5 is a perspective view of the first embodiment of the shock suppressing apparatus in its collapsed position.
Figure 6:
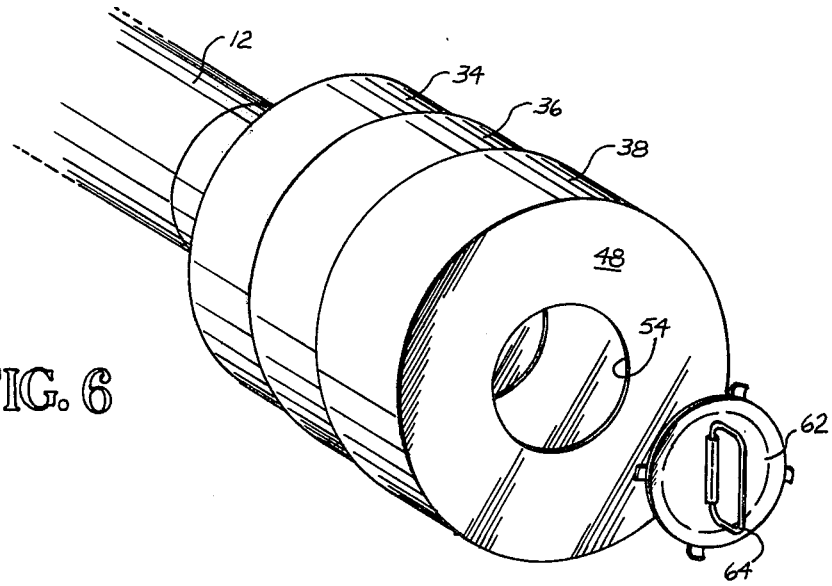
FIG. 6 is a perspective view similar to FIG. 5, showing the shock suppressing apparatus in its expanded operating position.

The particular sound suppressor 30 disclosed herein is designed as a relatively inexpensive, disposable device which can be used for one firing and then discarded. In its stowed position, the three housing sections 34, 36 and 38 are simply telescoped over one another to make an easily stowed item, as shown in FIG. 3. When it is desired to use one of the suppressors 30, it is placed in its stowed condition on the aft end 24 of the launch tube 12 (as shown in FIG. 5), the handle 64 is grasped to pull the three housing sections 34, 36 and 38 outwardly to their extended condition, and the cap 64 is then removed, as shown in the FIG. 6.

To analyze the operating characteristics of the present invention, it can be seen that the three housing sections 34, 36 and 38 collectively define an expansion chamber 66, with the two baffles 50 and 52 extending into the expansion chamber 66, and the rear baffle 54 defining the rear end of the expansion chamber 66. The three openings 50, 52 and 54 are made large enough to permit free passage of the plug 22 therethrough after ignition of the rocket 18. Each of the baffles 44, 46 and 48 are made of material which will yield moderately when exposed to the shock of the gases being emitted immediately after ignition of the rocket 18. This can be accomplished by selecting a somewhat maleable material for the baffles 44, 46 and 48 and/or scoring the material making up the baffles 44, 46 and 48 to weaken them so that they will yield to the desired extent.

Upon firing, the plug 22 travels rearwardly through the openings 50, 52 and 54, with the shock wave being created at the same time as the expulsion of the plug 22. To indicate the manner in which the suppressor 30 reduces the intensity of the initial shock, it is first to be understood that this shock is emitted from the aft end 24 of the tube 12 as a radially expanding shock wave which expands into the chamber 66. As this shock front approaches the first baffle 44, a portion of this shock passes through the first opening 50, while another portion of the shock strikes the baffle 44. The baffle 44 yields to a moderate extent to absorb part of the energy of the shock wave, and it also partially reflects the shock wave in a generally forward direction back toward the launch tube 12. That portion of shock wave which passes through the first opening 50 then expands into the intermediate portion of the expansion chamber 66, with a portion of this remaining shock wave passing through the second opening 52, and another portion of this remaining shock wave striking the second baffle 46. In like manner, this baffle 46 partially absorbs the energy of the reamining shock wave by yielding moderately, and also partially reflects this shock wave portion generally forwardly. The remaining shock wave which passes through the second opening 52 then expands into the third portion of the chamber 66, with a portion of this remaining shock wave passing out the rear opening 54, and another portion of the shock wave striking the rear baffle 48. This baffle 48 likewise yields to some extent to absorb part of the energy of the shock wave, and also reflects part of that shock wave portion in a generally forward direction.

The effect of that portion of the shock wave which impinges on the rearmost baffle 48 is illustrated in FIGS. 9A and 9B. It can be seen that in FIG. 9A, the final shock wave portion 67 is traveling rearwardly but has not yet reached the baffle 48. In FIG. 9B, it can be seen that when the shock wave portion 67 actually reaches the location of the rear baffle 48, a middle portion 67*a* passes through the rear opening 54, while a second portion of the wave strikes the baffle 48. The baffle 48 deforms moderately to absorb a portion of the energy, and a portion of the shock wave 67 is reflected, as at 67*b*, in a generally inward and forward direction.

The overall effect of the suppressor 30 is to substantially reduce the intensity of the shock emitted from the aft end 24 of the launch tube 12. After the initial shock has been dissipated, there is for a period thereafter a continuous base level noise of the exhaust gases exiting from the suppressor 30. However, this base line noise is within the limits which can be reasonably tolerated by the operator of the rocket launcher 10. The baffles 44–48 serve the additional function of providing a counteracting force to balance any tendency which the gaseous discharge from the launch 12 may have to tend to propel the launch tube 12 forwardly.

To demonstrate the effectiveness of the present invention, a shock suppressor was built substantially as shown in FIGS. 2–6, except that the frusto-conical section 56 was formed as a radially extending wall perpendicular to the longitudinal axis 60. The overall lengthwise dimension of the expansion chamber 66 was 3.75 inches. The diameter of the housing 32 was 2.5 inches; the diameter of the three openings 50, 52 and 54 was 1.0 inch. The diameter of the exit opening of the launcher 12 was approximately $\frac{5}{8}$ inch.

First, the suppressor 30, as described above, was left apart from the rocket launcher 12, and the rocket launcher 12 was then fired. A peak noise level of 149 decibels was recorded. Then the suppressor 30, with the particular dimensions noted above was added to the launcher 12, and the launcher 12 was fired a number of times. The average reading for peak noise level was 136 decibels, for a reduction of 13 decibels from the base line measurement of 149 decibels.

A second test was conducted in substantially the same manner as the first test, except that the dimensions of the suppressor 30 were enlarged, so that the overall length dimension of the expansion chamber 66 was 7.5 inches, and the diameter 5 inches. The other dimensions were the same. Without the suppressor 30 attached, the launcher 12 was fired, and a base line measurement of 147.2 decibels was recorded. When the suppressor with the larger dimensions was mounted to the launcher 12, and the launcher 12 was then fired, there was an average noise reduction of slightly over twenty decibels.

Thus it has been found that with the expansion chamber 66 having a diameter of at least two and one half times that of each of the openings 50–54, and with the surface area of each baffle 44–48 being about five times that of its related opening 50, 52 and 54, respectively, substantial sound reduction is achieved. Yet greater sound reduction is obtained by making the diameter of the expansion chamber 66 five times that of each of the baffle openings 50–54, with the area of each baffle member 44–48 thus being about twenty times as large as its related opening 50, 52 or 54 or greater.

A second embodiment of the present invention is shown in FIG. 7 and FIGS. 8A,B & C. Components of this second embodiment which are similar to components of the first embodiment will be given like numerical designations, with a prime (') designation distinguishing those of the second embodiment.

Thus, the shock suppressor 30' comprises a housing 32' with three telescoping sections 34', 36' and 38'. Also, there are the three baffles 44', 46' and 48', with the three through openings 50', 52' and 54', arranged in substantially the same manner as the first embodiment.

This second embodiment 30' differs from the first embodiment 30 in several respects. First, the side walls of the three housing sections 34', 36' and 38' are formed with a plurality of yielding plug members 68. With reference to FIGS. 8A–C, these plug members 68 are provided by forming the cylindrical side walls 34'–38' with circular scoring. For each plug member 68, there are two deeper scores 70 on the inner and outer surfaces of the wall sections, and these are adjacent and directly opposite one another and make approximately a 270° arc. There is a third score 72 which is less deep, and which completes a circle with the two other scores 70.

Figure 10:
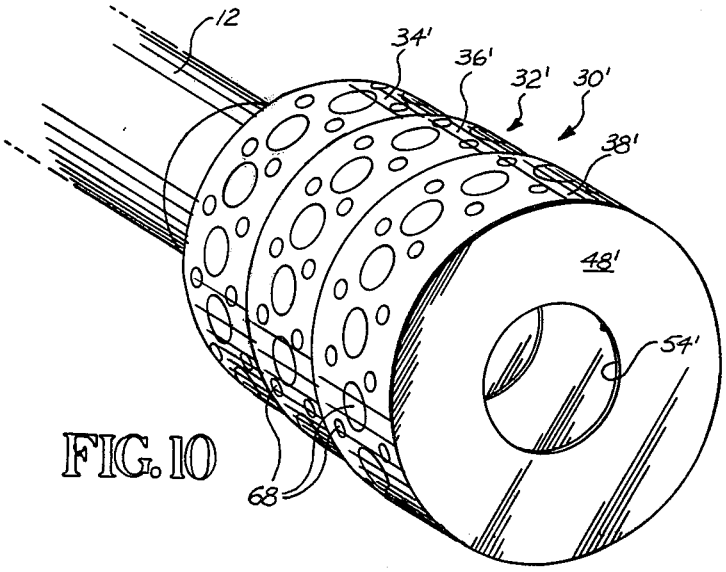
FIG. 10 is an isometric view of the embodiment shown in FIG. 7.

These scores 70 and 72 are of a proper depth so that as the shock wave impinges upon the plug 68, the material at the location of the two deeper scores 70 gives way so that the plug 68 breaks free of the remaining side wall about the score lines 70—70. Then the plug 68 deflects outwardly with the material at the score line 72 acting as a hinge. The outward movement of the plug 68 then leaves a generally cylindrical hole 74, as shown in Figure C. These plugs 68 are arranged in random sizes and locations over the surfaces of the housing sections 34'-38'. (This is best illustrated in FIG. 10.)

Also, the interior surface of each of the cylindrical telescoping sections 34'-38' is formed with a woven meshlike material, indicated at 76. This material can be a metallic woven material or a composite of metal/plastic material. One such suitable material is sold under the trademark "Metex", made by the Metex Corporation. This material is sufficiently perforate to permit gases to flow therethrough, while having a substantial effect in diminishing sound.

Also, the cylindrical housing section 34'-38' and the three baffle members 44', 46' and 48', are made of a sound decoupling material. Such materials are well known in the prior art, and comprise two metallic layers, separated by an acoustic material. For convenience of illustration, a cross-section of this material is not illustrated in FIGS. 7 and 8A-C, but is shown only in FIGS. 9C and 9D, with the two metallic or plastic layers being indicated at 78, and the intermediate sound absorbing material being indicated at 80. Typical sound decoupling materials are those sold under the trademark "MPM Noiseless Steel" and "Tufcote", made by Specialty Composites Corporation of Newark, Delaware.

The operation of this second embodiment 30' is in some respects the same as that of the first embodiment 30, in that the shock suppressor 30' is mounted to the aft end of the launch tube 12, and pulled out to its expanded position. Upon firing, the plug 22 exits through the holes 50', 52' and 54', and a shock wave travels through the expansion chamber 66', with the shock wave being partially attenuated and partially reflected as it proceeds through each section of the expansion chamber 66'. However, the second embodiment 30' has additional sound attenuating functions not present in the first embodiment 30.

With regard to the deformable plug members 68, when the shock wave hits such plug members 68, these are pushed outwardly to the position shown in FIG. 8C. The fact that energy is required to initially break the material at the location of the scores 70 and then bend the plugs 68 outwardly about the hinge line 72 causes an absorption of a certain amount of sound energy. In addition, the size of the plugs 68 are so selected that the holes 74 formed by the outward deflection of the plugs 68 act as tuned emitters. Such tuned emitters are sized to effectively pass sound frequencies with a wave length equal to or less than the diameter of the hole. As indicated previously, these plugs 68 are provided in random sizes and locations over the surface of the housing sections 34'-38'. After the initial peak shock has passed these holes 74, these have the additional function of diminishing the level of the steady state noise resulting from exhaust gases continuing to be emitted from the launch tube 12 and through the suppressing device 30'.

Figure 9C:
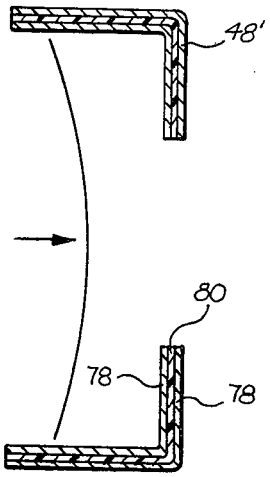
FIGS. 9C and 9D are Figures similar to 9A and 9B, respectively, illustrating a modified construction of the sound suppressor of the present invention.
Figure 9D:
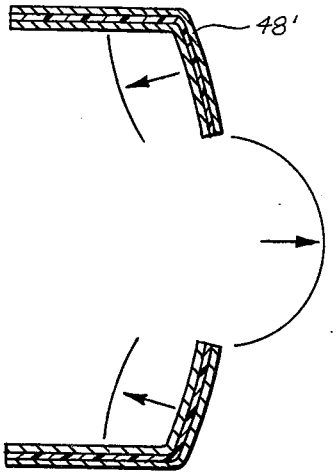

With regard to the use of the coupling material 78-80, the benefit obtained by the use of such material 78-80 is to be better able to absorb a larger percentage of the sound energy. Also, as illustrated in FIGS. 9C and 9D, in addition to absorbing the energy, the baffles 44', 46' and 48' function in the same manner as the first embodiment to reflect back a portion of the shock wave.

What is claimed is:

1. A method of suppressing a shock wave generated by a rocket launching device, wherein the rocket launching device comprises an elongate launch tube having a longitudinal axis, a forward end from which a rocket is fired, and a rear exhaust end through which exhaust gases exit during firing of the rocket, said exhaust end having a predetermined cross-sectional area and diameter, said method comprising:

a. providing a substantially enclosed expansion chamber having a diameter and cross-sectional area substantially greater than the diameter and cross-sectional area of the exhaust end of the launch tube, b. providing annular baffle means extending in said chamber radially inwardly toward the longitudinal axis of the launch tube, c. providing in said baffle means longitudinally aligned opening means to permit rearward ejection of a nozzle plug from a rocket mounted in said launch tube and to permit rearward discharge of gaseous exhaust from said rocket, d. suppressing a shock wave generated by firing the rocket in the launch tube by partially absorbing the shock wave by the baffle means, and partially reflecting the shock wave back toward the launch tube by the baffle means, thereby suppressing the shock wave.

2. The method as recited in claim 1, further providing said baffle means in the form of a moderately yielding material, having a yield strength which is such relative to the shock wave generated by said launcher that said baffle means will yield moderately under the impact of said shock wave and thus diminish the energy of the shock wave.

3. The method as recited in claim 1, absorbing said shock wave by means of a sound energy absorbing material, which comprises said baffle means, so that in addition to reflecting the shock wave impinging thereon, a substantial amount of the energy of said shock wave is absorbed in said sound absorbing material.

4. The method as recited in claim 1, further comprising absorbing and reflecting said shock wave by means of a plurality of longitudinally spaced, radially inwardly extending baffles positioned in said expansion chamber along the longitudinal axis of the launcher, with each of said baffles having a center through opening and presenting a generally forward facing reflecting surface to partially absorb and partially reflect shock wave portions impinging thereagainst.

5. The method as recited in claim 4, said method further comprising:

a. providing a housing as a plurality of telescoping housing sections, b. first arranging said telescoping housing sections relative to one another in a collapsed stored position with the housing sections telescoped one within the other, c. attaching the housing to the launch tube and expanding the housing sections to an expanded position with the telescoping sections spaced longitudinally from one another to define said expansion chamber.

6. The method as recited in claim 1, wherein said housing comprises a circumferential side wall, further comprising providing said side wall with a plurality of deformable plug members at spaced locations therein, said plug members being deformable outwardly under impact of the shock wave thereon to provide through openings when so outwardly deformed, said plug members thus absorbing energy in being outwardly deformed, and also providing sound attenuating openings in said housing.

7. The method as recited in claim 6, further comprising emitting gas into said expansion chamber and passing said gas through a perforate sound absorbing material located in said circumferential side wall and then outwardly through the openings formed by deformation of said plugs outwardly from the housing.

8. In combination with a rocket launching device, said rocket launching device comprising an elongate launch tube having a longitudinal axis, a forward end from which a rocket is fired, and a rear exhaust end through which exhaust gases exit during firing of the rocket, said exhaust end having an exhaust opening of a predetermined cross-sectional area and diameter, a shock suppressing apparatus comprising:

a. a circumferential housing having a longitudinal axis, a forward end adapted to be mounted to the rear exhaust end of the launch tube so that the longitudinal axis of the housing is in general alignment with the longitudinal axis of the launch tube, and a rear end, b. said housing defining a substantially enclosed expansion chamber having a diameter and cross-sectional area substantially greater than the diameter and cross-sectional area of the exhaust opening of the launch tube, c. annular baffle means extending from said housing radially inwardly toward the longitudinal axis of the housing, said baffle means defining longitudinally aligned opening means to permit rearward ejection of a nozzle plug from a rocket mounted in said launch tube and to permit rearward discharge of gaseous exhaust from said rocket, said baffle means presenting forwardly facing surface means to reflect a shock wave emitted from said launch tube, whereby with said shock suppressing apparatus mounted to said launch tube, a shock wave generated by firing the rocket in the launch tube travels rearwardly and expands into the expansion chamber, with the shock wave being partially absorbed by the suppressing apparatus, and partially reflected back toward the launch tube, thereby suppressing the shock wave, said apparatus further characterized in that a. said baffle means comprises a plurality of longitudinally spaced, radially inwardly extending baffles positioned in said expansion chamber along the longitudinal axis of the housing, with each of said baffles having a center through opening and presenting a generally forward facing reflecting surface to partially absorb and partially reflect shock wave portions impinging thereagainst, b. said housing is formed as a plurality of housing sections, arranged relative to one another to have a collapsed stored position with the housing sections telescoped one within the other, and an expanded operating position with the telescoping sections spaced longitudinally from one another to define said expansion chamber.

9. The apparatus as recited in claim 8, wherein the diameter of said expansion chamber is at least as great as approximately two and one half times the diameter of each of said openings.

10. The apparatus as recited in claim 8, wherein each of said baffle members has an area at least as great as approximately five times the area of each of the openings defined by each baffle member.

11. The apparatus as recited in claim 8, wherein said baffle means is made of a moderately yielding material, having a yield strength which is such relative to the shock wave generated by said launcher that said baffle means will yield moderately under the impact of said shock wave and thus diminish the energy of the shock wave.

12. The apparatus as recited in claim 8, wherein the diameter of said expansion chamber is at least as great as approximately five times the diameter of each of said through openings defined by each of said baffles.

13. The apparatus as recited in claim 12, wherein the surface area of each baffle is at least as great as approximately twenty times the area of the opening defined thereby.

14. In combination with a rocket launching device, said rocket launching device comprising an elongate launch tube having a longitudinal axis, a forward end from which a rocket is fired, and a rear exhaust end through which exhaust gases exit during firing of the rocket, said exhaust end having an exhaust opening of a predetermined cross-sectional area and diameter, a shock suppressing apparatus comprising:

a. a circumferential housing having a longitudinal axis, a forward end adapted to be mounted to the rear exhaust end of the launch tube so that the longitudinal axis of the housing is in general alignement with the longitudinal axis of the launch tube, and a rear end, b. said housing defining a substantially enclosed expansion chamber having a diameter and cross-sectional area substantially greater than the diameter and cross-sectional area of the exhaust opening of the launch tube, c. annular baffle means extending from said housing radially inwardly toward the longitudinal axis of the housing, said baffle means defining longitudinally aligned opening means to permit rearward ejection of a nozzle plug from a rocket mounted in said launch tube and to permit rearward discharge of gaseous exhaust from said rocket, said baffle means presenting forwardly facing surface means to reflect a shock wave emitted from said launch tube, whereby with said shock suppressing apparatus mounted to said launch tube, a shock wave generated by firing the rocket in the launch tube travels rearwardly and expands into the expansion chamber, with the shock wave being partially absorbed by the suppressing apparatus, and partially reflected back toward the launch tube, thereby suppressing the shock wave, said apparatus further characterized in that said baffle means is made of a sound energy absorbing material, so that in addition to reflecting the shock wave impinging thereon, a substantial amount of the energy of said shock wave is absorbed in said sound absorbing material.

15. In combination with a rocket launching device, said rocket launching device comprising an elongate launch tube having a longitudinal axis, a forward end from which a rocket is fired, and a rear exhaust end through which exhaust gases exit during firing of the rocket, said exhaust end having an exhaust opening of a predetermined cross-sectional area and diameter, a shock suppressing apparatus comprising:

a. a circumferential housing having a longitudinal axis, a forward end adapted to be mounted to the rear exhaust end of the launch tube so that the longitudinal axis of the housing is in general alignment with the longitudinal axis of the launch tube, and a rear end, b. said housing defining a substantially enclosed expansion chamber having a diameter and cross-sectional area substantially greater than the diameter and cross-sectional area of the exhaust opening of the launch tube, c. annular baffle means extending from said housing radially inwardly toward the longitudinal axis of the housing, said baffle means defining longitudinally aligned opening means to permit rearward ejection of a nozzle plug from a rocket mounted in said launch tube and to permit rearward discharge of gaseous exhaust from said rocket, said baffle means presenting forwardly facing surface means to reflect a shock wave emitted from said launch tube, whereby with said shock suppressing apparatus mounted to said launch tube, a shock wave generated by firing the rocket in the launch tube travels rearwardly and expands into the expansion chamber, with the shock wave being partially absorbed by the suppressing apparatus, and partially reflected back toward the launch tube, thereby suppressing the shock wave, said apparatus further characterized in that a. said baffle means is made of a moderately yielding material, having a yield strength which is such relative to the shock wave generated by said launcher that said baffle means will yield moderately under the impact of said shock wave and thus diminish the energy of the shock wave, and b. said baffle means is made of a sound energy absorbing material, so that in addition to reflecting the shock wave impinging thereon, a substantial amount of the energy of said shock wave is absorbed in said sound absorbing material.

16. In combination with a rocket launching device, said rocket launching device comprising an elongate launch tube having a longitudinal axis, a forward end from which a rocket is fired, and a rear exhaust end through which exhaust gases exit during firing of the rocket, said exhaust end having an exhaust opening of a predetermined cross-sectional area and diameter, a shock suppressing apparatus comprising:

a. a circumferential housing having a longitudinal axis, a forward end adapted to be mounted to the rear exhaust end of the launch tube so that the longitudinal axis of the housing is in general alignment with the longitudinal axis of the launch tube, and a rear end, b. said housing defining a substantially enclosed expansion chamber having a diameter and cross-sectional area substantially greater than the diameter and cross-sectional area of the exhaust opening of the launch tube, c. annular baffle means extending from said housing radially inwardly toward the longitudinal axis of the housing, said baffle means defining longitudinally aligned opening means to permit rearward ejection of a nozzle plug from a rocket mounted in said launch tube and to permit rearward discharge of gaseous exhaust from said rocket, said baffle means presenting forwardly facing surface means to reflect a shock wave emitted from said launch tube, whereby with said shock suppressing apparatus mounted to said launch tube, a shock wabe generated by firing the rocket in the launch tube travels rearwardly and expands into the expansion chamber, with the shock wave being partially reflected back toward the launch tube, thereby suppressing the shock wave, said apparatus further characterized in that said housing comprises a circumferential side wall, said side wall having a plurality of deformable plug members at spaced locations therein, said plug members being deformable outwardly under impact of the shock wave thereon to provide through openings when so outwardly deformed, said plug members thus absorbing energy in being outwardly deformed, and also providing sound attenuating openings in said housing.

17. The apparatus as recited in claim 16, wherein there is located within said circumferential side wall a perforate sound absorbing material, whereby gas emitted into said expansion chamber passes through said sound absorbing material and then outwardly through the openings formed by deformation of said plug members outwardly from the housing.

18. In combination with a rocket launching device, said rocket launching device comprising an elongate launch tube having a longitudinal axis, a forward end from which a rocket is fired, and a rear exhaust end through which exhaust gases exit firing of the rocket, said exhaust end having an exhaust opening of a predetermined cross-sectional area and diameter, said shock suppressing apparatus comprising:

a. a circumferential housing having a longitudinal axis, a forward end adapted to be mounted to the rear exhaust end of the launch tube so that the longitudinal axis of the housing is in general alignment with the longitudinal axis of the launch tube, and a rear end, b. said housing defining a substantially enclosed expansion chamber having a diameter and cross-sectional area substantially greater than the diameter and cross-sectional area of the exhaust opening of the launch tube, c. a plurality of longitudinally spaced, radially inwardly extending baffles positioned in said expansion chamber along the longitudinal axis of the housing, with each of said baffles having a center through opening and presenting a generally forward facing reflecting surface to partially absorb and partially reflect shock wave portions impinging thereagainst, whereby with said shock suppressing apparatus mounted to said launch tube, a shock wave generated by firing the rocket in the launch tube travels rearwardly and expands into the expansion chamber, with the shock wave being partially absorbed by the suppressing apparatus, and partially reflected back toward the launch tube, thereby suppressing the shock wave, said apparatus being further characterized in that said housing is formed as a plurality of housing sections, arranged relative to one another to have a collapsed stored position with the housing sections telescoped one within the other, and an expanded operating position with the telescoping sections spaced longitudinally from one another to define said expansion chamber.

19. The apparatus as recited in claim 18, wherein said baffles are made of a moderately yielding material, having a yield strength which is such relative to the shock wave generated by said launcher that said baffles will yield moderately under the impact of said shock wave and thus diminish the energy of the shock wave.

20. The apparatus as recited in claim 18, wherein said baffles are made of a sound energy absorbing material, so that in addition to reflecting the shock wave impinging thereon, a substantial amount of the energy of said shock wave is absorbed in said sound absorbing material.

21. The apparatus as recited in claim 18, wherein:

a. said baffles are made of a moderately yielding material, having a yield strength which is such relative to the shock wave generated by said launcher that said baffles will yield moderately under the impact of said shock wave and thus diminish the energy of the shock wave, b. said baffles are made of a sound energy absorbing material, so that in addition to reflecting the shock wave impinging thereon, a substantial amount of the energy of said shock wave is absorbed in said sound absorbing material.

22. The apparatus as recited in claim 18, wherein a. the diameter of said expansion chamber is at least as great as approximately two and one half times the diameter of each of said openings, b. each of said baffle members has an area at least as great as approximately five times the area of each of the openings defined by each baffle member, c. said baffles are made of a moderately yielding material, having a yield strength which is such relative to the shock wave generated by said launcher that said baffles will yield moderately under the impact of said shock wave and thus diminish the energy of the shock wave, d. said baffles are made of a sound energy absorbing material, so that in addition to reflecting the shock wave impinging thereon, a substantial amount of the energy of said shock wave is absorbed in said sound absorbing material, e. said housing structure comprises a circumferential side wall, said side wall having a plurality of deformable plug members at spaced locations therein, said plug members being deformable outwardly under impact of the shock wave thereon to provide through openings when so outwardly deformed, said plug members thus absorbing energy in being outwardly deformed, and also provided sound attenuating openings in said housing.

23. The apparatus as recited in claim 18, wherein:

a. each of said baffle members has an area at least as great as approximately five times the area of each of the openings defined by each baffle member, b. the diameter of said expansion chamber is at least as great as approximately five times the diameter of each of said through openings defined by each of said baffles, c. there is located within said circumferential side wall a perforate sound absorbing material, whereby gas emitted into said expansion chamber passes through said sound absorbing material and then outwardly through the openings formed by deformation of said plugs outwardly from the housing structure.

24. The apparatus as recited in claim 18, wherein the diameter of said expansion chamber is at least as great as approximately two and one half times the diameter of each of said openings.

25. The apparatus as recited in claim 24, wherein each of said baffle members has an area at least as great as approximately five times the area of each of the openings defined by each baffle.

26. The apparatus as recited in claim 18, wherein the diameter of said expansion chamber is at least as great as approximately five times the diameter of each of said through openings defined by each of said baffles.

27. The apparatus as recited in claim 21, wherein the surface area of each baffle is at least as great as approximately twenty times the area of the opening defined thereby.

28. The apparatus as recited in claim 18, wherein said housing structure comprises a circumferential side wall, said side wall having a plurality of deformable plug members at spaced locations therein, said plug members being deformable outwardly under impact of the shock wave thereon to provide through openings when so outwardly deformed, said plug members thus absorbing energy in being outwardly deformed, and also providing sound attenuating openings in said housing.

29. The apparatus as recited in claim 28, wherein there is located within said circumferential side wall a perforate sound absorbing material, whereby gas emitted into said expansion chamber passes through said sound absorbing material and then outwardly through the openings formed by deformation of said plugs outwardly from the housing structure.

30. A shock wave suppressing apparatus for a rocket launching device, said rocket launching device comprising an elongate launch tube having a longitudinal axis, a forward end from which a rocket is fired, and a rear exhaust end through which exhaust gases exit during firing of the rocket, said exhaust end having a predetermined cross-sectional area and diameter, said shock suppressing apparatus comprising:

a. circumferential housing having a longitudinal axis, a forward end having a forward opening and adapted to be mounted to the rear exhaust end of the launch tube so that the longitudinal axis of the housing is in general alignment with the longitudinal axis of the launch tube, and a rear end, b. said housing defining a substantially enclosed expansion chamber having a diameter and cross-sectional area substantially greater than the diameter and cross-sectional area of the forward opening, c. annular baffle means extending from said housing radially inwardly toward the longitudinal axis of the housing, said baffle means defining longitudinally aligned opening means to permit rearward ejection of a nozzle plug from a rocket mounted in said launch tube and to permit rearward discharge of gaseous exhaust from said rocket, said baffle means presenting forwardly facing surface means to reflect a shock wave entering the forward opening, d. said baffle means comprising a plurality of longitudinally spaced, radially inwardly extending baffles positioned in said expansion chamber along the longitudinal axis of the housing, with each of said baffles having a center through opening and presenting a generally forward facing reflecting surface to partially absorb and partially reflect shock wave portions impinging thereagainst, e. said housing being formed as a plurality of housing sections, arranged relative to one another to have a collapsed stored position with the housing sections telescoped one within the other, and an expanded operating position with the telescoping sections spaced longitudinally from one another to define said expansion chamber.

31. The apparatus as recited in claim 30, wherein said baffle means is made of a moderately yielding material, having a yield strength which is such relative to the shock wave generated by said launcher that said baffle means will yield moderately under the impact of said shock wave and thus diminish the energy of the shock wave.

32. The apparatus as recited in claim 30, wherein the diameter of said expansion chamber is at least as great as approximately two and one half times the diameter of each of said center through openings.

33. The apparatus as recited in claim 32, wherein each of said baffle members has an area at least as great as approximately five times the area of each of the center through openings defined by each baffle member.

34. The apparatus as recited in claim 30, wherein the diameter of said expansion chamber is at least as great as approximately five times the diameter of each of said through openings defined by each of said baffles.

35. The apparatus as recited in claim 34, wherein the surface area of each baffle is at least as great as approximately twenty times the area of the opening defined thereby.

36. A shock wave suppressing apparatus for a rocket launching device, said rocket launching device comprising an elongate launch tube having a longitudinal axis, a forward end from which a rocket is fired, and a rear exhaust end through which exhaust gases exit during firing of the rocket, said exhaust end having a predetermined cross-sectional area and diameter, said shock suppressing apparatus comprising:

a. a circumferential housing having a longitudinal axis, a forward end having a forward opening and adapted to be mounted to the rear exhaust end of the launch tube so that the longitudinal axis of the housing is in general alignment with the longitudinal axis of the launch tube, and a rear end, b. said housing defining a substantially enclosed expansion chamber having a diameter and cross-sectional area substantially greater than the diameter and cross-sectional area of the forward opening, c. annular baffle means extending from said housing radially inwardly toward the longitudinal axis of the housing, said baffle means defining longitudinally aligned opening means to permit rearward ejection of a nozzle plug from a rocket mounted in said launch tube and to permit rearward discharge of gaseous exhaust from said rocket, said baffle means presenting forwardly facing surface means to reflect a shock wave entering the forward opening, d. said baffle means being made of a sound energy absorbing material, so that in addition to reflecting the shock wave impinging thereon, a substantial amount of the energy of said shock wave is absorbed in said sound absorbing material.

37. A shock wave suppressing apparatus for a rocket launching device, said rocket launching device comprising an elongate launch tube having a longitudinal axis, a forward end from which a rocket is fired, and a rear exhaust end through which exhaust gases exit during firing of the rocket, said exhaust end having a predetermined cross-sectional area and diameter, said shock suppressing apparatus comprising:

a. a circumferential housing having a longitudinal axis, a forward end having a forward opening and adapted to be mounted to the rear exhaust end of the launch tube so that the longitudinal axis of the housing is in general alignment with the longitudinal axis of the launch tube, and a rear end, b. said housing defining a substantially enclosed expansion chamber having a diameter and cross-sectional area substantially greater than the diameter and cross-sectional area of the forward opening, c. annular baffle means extending from said housing radially inwardly toward the longitudinal axis of the housing, said baffle means defining longitudinally aligned opening means to permit rearward ejection of a nozzle plug from a rocket mounted in said launch tube and to permit rearward discharge of gaseous exhaust from said rocket, said baffle means presenting forwardly facing surface means to reflect a shock wave entering the forward opening, d. said baffle means being made of a moderately yielding material, having a yield strength which is such relative to the shock wave generated that said baffle means will yield moderately under the impact of said shock wave and thus diminish the energy of the shock wave, and e. said baffle means being made of a sound energy absorbing material, so that in addition to reflecting the shock wave impinging thereon, a substantial amount of the energy of said shock wave is absorbed in said sound absorbing material.

38. A shock wave suppressing apparatus for a rocket launching device, said rocket launching device comprising an elongate launch tube having a longitudinal axis, a forward end from which a rocket is fired, and a rear exhaust end through which exhaust gases exit during firing of the rocket, said exhaust end having a predetermined cross-sectional area and diameter, said shock suppressing apparatus comprising:

a. a circumferential housing having a longitudinal axis, a forward end having a forward opening and adapted to be mounted to the rear exhaust end of the launch tube so that the longitudinal axis of the housing is in general alignment with the longitudinal axis of the launch tube, and a rear end, b. said housing defining a substantially enclosed expansion chamber having a diameter and cross-sectional area substantially greater than the diameter and cross-sectional area of the forward opening, c. annular baffle means extending from said housing radially inwardly toward the longitudinal axis of the housing, said baffle means defining longitudinally aligned opening means to permit rearward ejection of a nozzle plug from a rocket mounted in said launch tube and to permit rearward discharge of gaseous exhaust from said rocket, said baffle means presenting forwardly facing surface means to reflect a shock wave entering the forward opening, d. said housing comprising a circumferential side wall, said side wall having a plurality of deformable plug members at spaced locations therein, said plug members being deformable outwardly under impact of the shock wave thereon to provide through openings when so outwardly deformed, said plug members thus absorbing energy in being outwardly deformed, and also providing sound attentuating openings in said housing.

39. The apparatus as recited in claim 38, wherein there is located within said circumferential side wall a perforate sound absorbing material, whereby gas emitted into said expansion chamber passes through said sound absorbing material and then outwardly through the openings formed by deformation of said plug members outwardly from the housing.

* * * * *